US011359420B2

(12) United States Patent
Singh et al.

(10) Patent No.: US 11,359,420 B2
(45) Date of Patent: Jun. 14, 2022

(54) PIVOTED LOCKABLE LATCH ACTUATOR

(71) Applicant: GM Global Technology Operations LLC, Detroit, MI (US)

(72) Inventors: Gurnek Singh, Sterling Heights, MI (US); Scott J. Fast, Macomb, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 401 days.

(21) Appl. No.: 16/425,380

(22) Filed: May 29, 2019

(65) Prior Publication Data

US 2020/0378163 A1 Dec. 3, 2020

(51) Int. Cl.

| | |
|---|---|
| ***E05B 83/30*** | (2014.01) |
| *E05B 85/16* | (2014.01) |
| *E05B 83/32* | (2014.01) |

(52) U.S. Cl.

CPC ..... *E05B 83/30* (2013.01); *E05B 83/32* (2013.01); *E05B 85/16* (2013.01)

(58) Field of Classification Search

CPC ..... E05B 83/30; E05B 83/32; E05B 85/16; B60R 7/06; Y10T 292/0972; Y10T 292/0994; Y10T 292/097; Y10T 292/102; Y10S 292/31

USPC ..... 296/37.12

See application file for complete search history.

(56) References Cited

U.S. PATENT DOCUMENTS

| | | | | |
|---|---|---|---|---|
| 8,141,398 | B2 * | 3/2012 | Ookawara | E05C 1/145 70/208 |
| 8,448,483 | B2 * | 5/2013 | Brant | B60R 7/04 70/162 |
| 8,590,351 | B2 * | 11/2013 | Ookawara | E05B 83/30 70/162 |
| 9,074,389 | B2 * | 7/2015 | Shimizu | E05C 9/043 |
| 2019/0234120 | A1 * | 8/2019 | Flaute | E05B 83/30 |
| 2020/0408010 | A1 * | 12/2020 | Takai | E05B 79/14 |
| 2021/0140204 | A1 * | 5/2021 | Minnich | E05C 9/043 |

FOREIGN PATENT DOCUMENTS

WO WO-2015019571 A1 * 2/2015 ..... E05C 9/043

* cited by examiner

*Primary Examiner* — Kristina R Fulton
*Assistant Examiner* — Noah Horowitz
(74) *Attorney, Agent, or Firm* — Vivacqua Crane PLLC

(57) ABSTRACT

A door latch for a motor vehicle compartment includes a latch pawl having a locked position and an unlocked position, the locked position preventing access to the compartment, the unlocked position providing access to the compartment, and an actuator that rotates about a first pivot point. The actuator selectively engages with the latch pawl to move the latch pawl from the locked position to the unlocked position.

12 Claims, 6 Drawing Sheets

PIVOTED LOCKABLE LATCH ACTUATOR

INTRODUCTION

The present disclosure relates to door latch for a motor vehicle compartment. More specifically, the present disclosure relates to a door latch actuator that is lockable.

A typical motor vehicle includes various compartments within the cabin of the motor vehicle to storage areas. For example, most motor vehicles include a glove box situated in the dashboard region in front of the front passenger seat in the cabin. Some motor vehicles include a console situated between the driver seat and the front passenger seat. In various vehicles, the compartments have a mechanism that can be locked to deny access to the compartments, for example, by a thief. In an attempted break-in, however, a thief may pull on the mechanism, which results in breakage of the mechanism in some situations.

Thus, while current door latches achieve their intended purpose, there is a need for a new and improved system to lock compartments within the cabin of motor vehicles.

SUMMARY

According to several aspects, a door latch for a motor vehicle compartment includes a latch pawl having a locked position and an unlocked position, the locked position preventing access to the compartment, the unlocked position providing access to the compartment, and an actuator that rotates about a first pivot point. The actuator selectively engages with the latch pawl to move the latch pawl from the locked position to the unlocked position.

In an additional aspect of the present disclosure, the door further includes a lock with a barrel and an extension that selectively extends from the barrel, the extension having a first positon corresponding to the latch pawl's locked position and a second position corresponding to the latch pawl's unlocked position.

In another aspect of the present disclosure, when the barrel moves about a second pivot point and the extension is in the first position, the actuator does not engage with the latch pawl such that the latch pawl remains in the locked position.

In another aspect of the present disclosure, when the barrel moves about the second pivot point and the extension is in the second position, the extension engages with the actuator which causes the actuator to engage with the latch pawl to move the latch pawl to the unlocked position.

In another aspect of the present disclosure, the barrel is housed in a handle and the handle is configured to rotate about the second pivot point.

In another aspect of the present disclosure, when an occupant of the motor vehicle pulls on the handle and the extension is in the first position, the handle rotates about the second pivot point while the latch pawl remains in the locked position.

In another aspect of the present disclosure, when an occupant of the motor vehicle pulls on the handle and the extension is in the second position, the handle rotates about the second pivot point and actuator rotates about the first pivot point to move the latch pawl to the unlocked position.

In another aspect of the present disclosure, the compartment is a glove box.

In another aspect of the present disclosure, the compartment is a console situated in a cabin of the motor vehicle.

According to several aspects, a door latch for a motor vehicle compartment includes a latch pawl having a locked position and an unlocked position, the locked position preventing access to the compartment, the unlocked position providing access to the compartment, an actuator that rotates about a first pivot point, the actuator selectively engaging with the latch pawl to move the latch pawl from the locked position to the unlocked position, and a lock with a barrel and an extension that selectively extends from the barrel, the extension having a first positon corresponding to the latch pawl's locked position and a second position corresponding to the latch pawl's unlocked position.

In another aspect of the present disclosure, when the barrel moves about a second pivot point and the extension is in the first position, the actuator does not engage with the latch pawl such that the latch pawl remains in the locked position.

In another aspect of the present disclosure, when the barrel moves about the second pivot point and the extension is in the second position, the extension engages with the actuator which causes the actuator to engage with the latch pawl to move the latch pawl to the unlocked position.

In another aspect of the present disclosure, the barrel is housed in a handle and the handle is configured to rotate about the second pivot point.

In another aspect of the present disclosure, when an occupant of the motor vehicle pulls on the handle and the extension is in the first position, the handle rotates about the second pivot point while the latch pawl remains in the locked position.

In another aspect of the present disclosure, when an occupant of the motor vehicle pulls on the handle and the extension is in the second position, the handle rotates about the second pivot point and actuator rotates about the first pivot point to move the latch pawl to the unlocked position.

In another aspect of the present disclosure, the compartment is a glove box.

In another aspect of the present disclosure, the compartment is a console situated in a cabin of the motor vehicle.

According to several aspects, a motor vehicle includes a compartment with a door latch. The door latch includes a latch pawl having a locked position and an unlocked position, the locked position preventing access to the compartment, the unlocked position providing access to the compartment, an actuator that rotates about a first pivot point, the actuator selectively engaging with the latch pawl to move the latch pawl from the locked position to the unlocked position, a lock with a barrel and an extension that selectively extends from the barrel, the extension having a first positon corresponding to the latch pawl's locked position and a second position corresponding to the latch pawl's unlocked position. When the barrel moves about a second pivot point and the extension is in the first position, the actuator does not engage with the latch pawl such that the latch pawl remains in the locked position. And when the barrel moves about the second pivot point and the extension is in the second position, the extension engages with the actuator which causes the actuator to engage with the latch pawl to move the latch pawl to the unlocked position.

In another aspect of the present disclosure, the barrel is housed in a handle and the handle is configured to rotate about the second pivot point.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
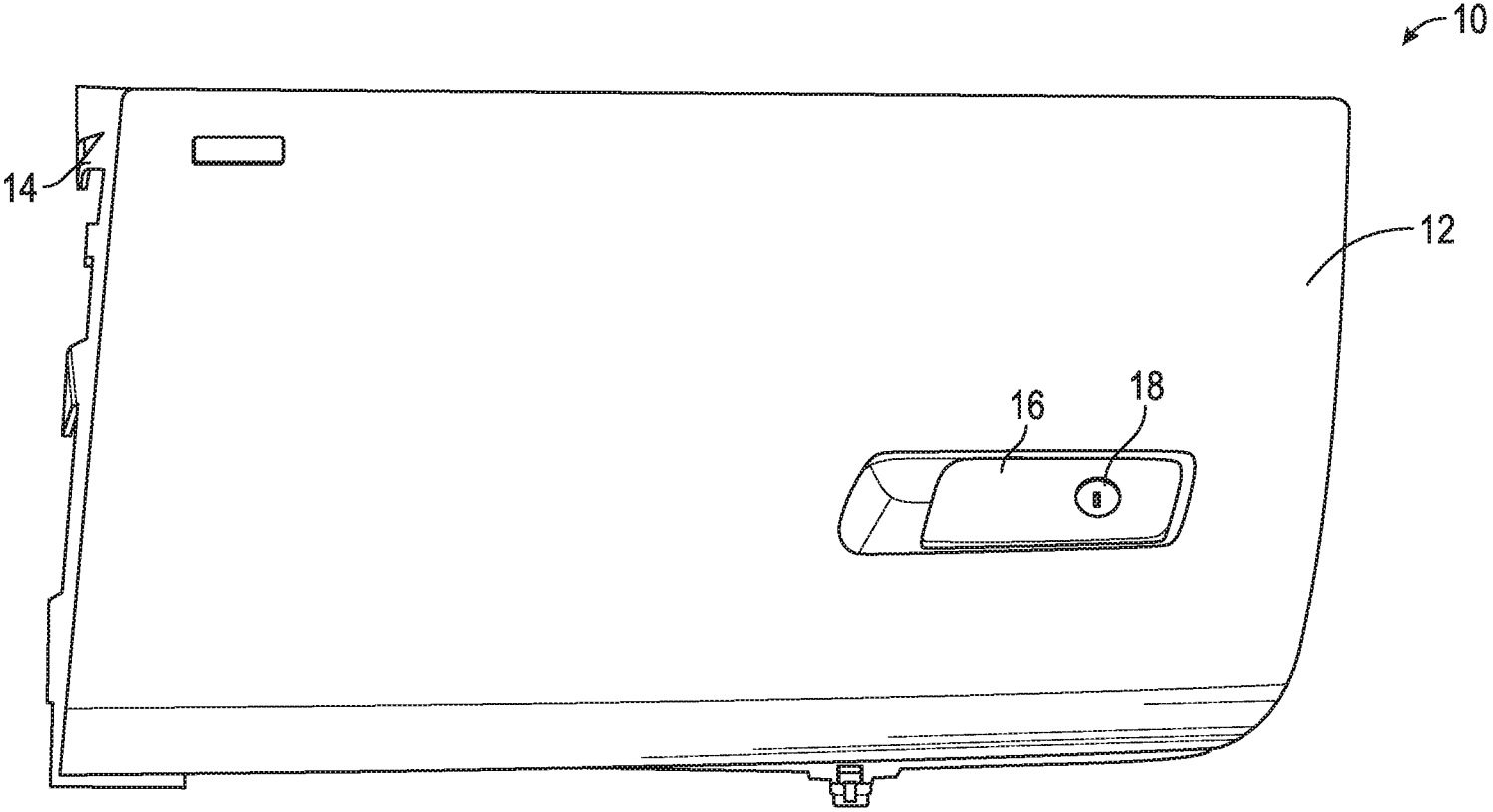
FIG. 1 is perspective view of a door for a motor vehicle compartment in accordance with the present disclosure.
Figure 2:
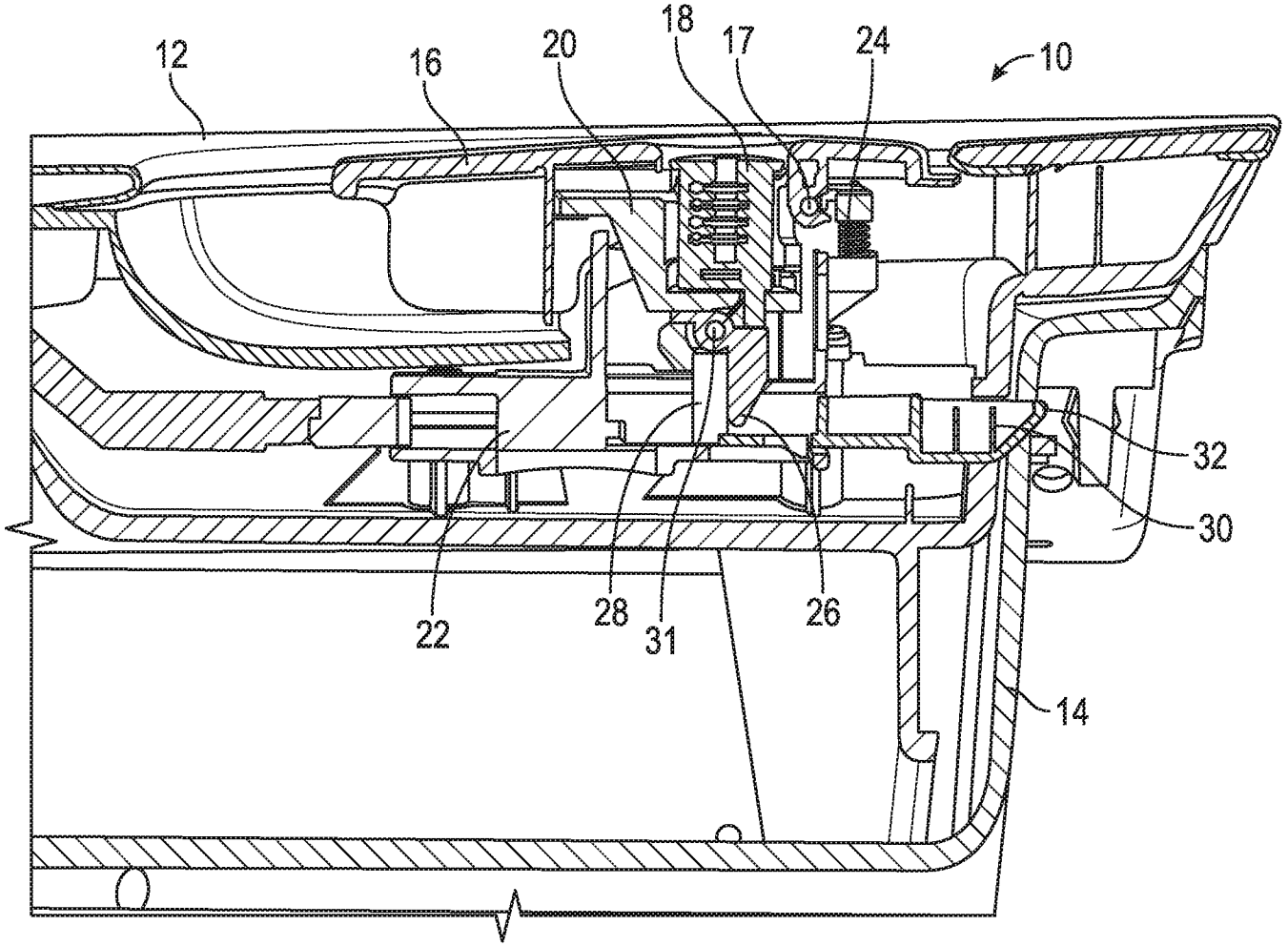
FIG. 2 is an interior view of a door latch for the compartment in accordance with the present disclosure.

Referring to FIGS. 1 and 2, there is shown a door latch 10 for a door 12. The door 12 allows access to a compartment defined by a frame 14. The compartment in various arrangements is a glove box or a console situated in a cabin of a motor vehicle. The door latch 10 includes a latch pawl 30 positioned in a support member 22 of the door 12. When an end 32 of the latch pawl 30 engages with the frame 14, access to the compartment is denied, while disengaging the end 32 from the frame 14 provides access to the compartment.

The door latch 10 further includes a handle 16, a lock with a barrel 18 and a spring 24 that biases the handle 16 and the lock 18 in a closed position. The lock barrel 18 is housed in a support member 20 positioned in the handle 16. The handle 16 is attached to the frame 14 at a pivot point 17. Accordingly, when the handle 16 is lifted by an occupant residing in the cabin of the motor vehicle, the handle 12, as well as the lock 18 barrel, rotate about the pivot point 17 to open the door 12 when the lock barrel 18 is unlocked, providing access to the compartment. Lifting the handle 16 compresses the spring 24 such that when a lifting force is removed from the handle 16, the biasing force from the spring 24 pushes the handle 16 to its un-lifted position.

The door latch 10 also includes an actuator 26 that pivots about a pivot point 31. The actuator 26 selective engages with a portion 28 of the latch pawl 30.

Figure 3:
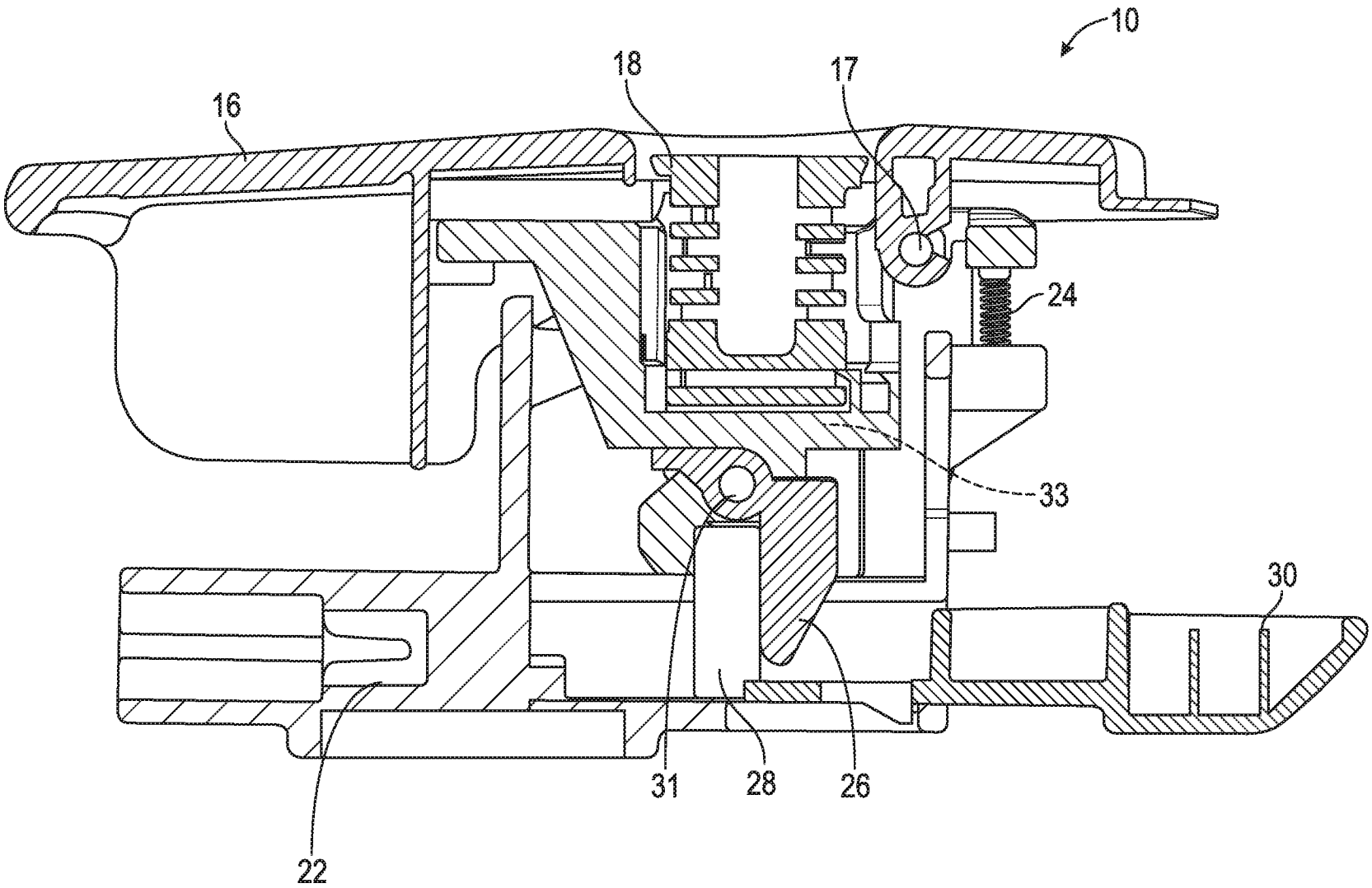
FIG. 3 is a close-up interior view of the door latch for the compartment in an locked position in accordance with the present disclosure.
Figure 4:
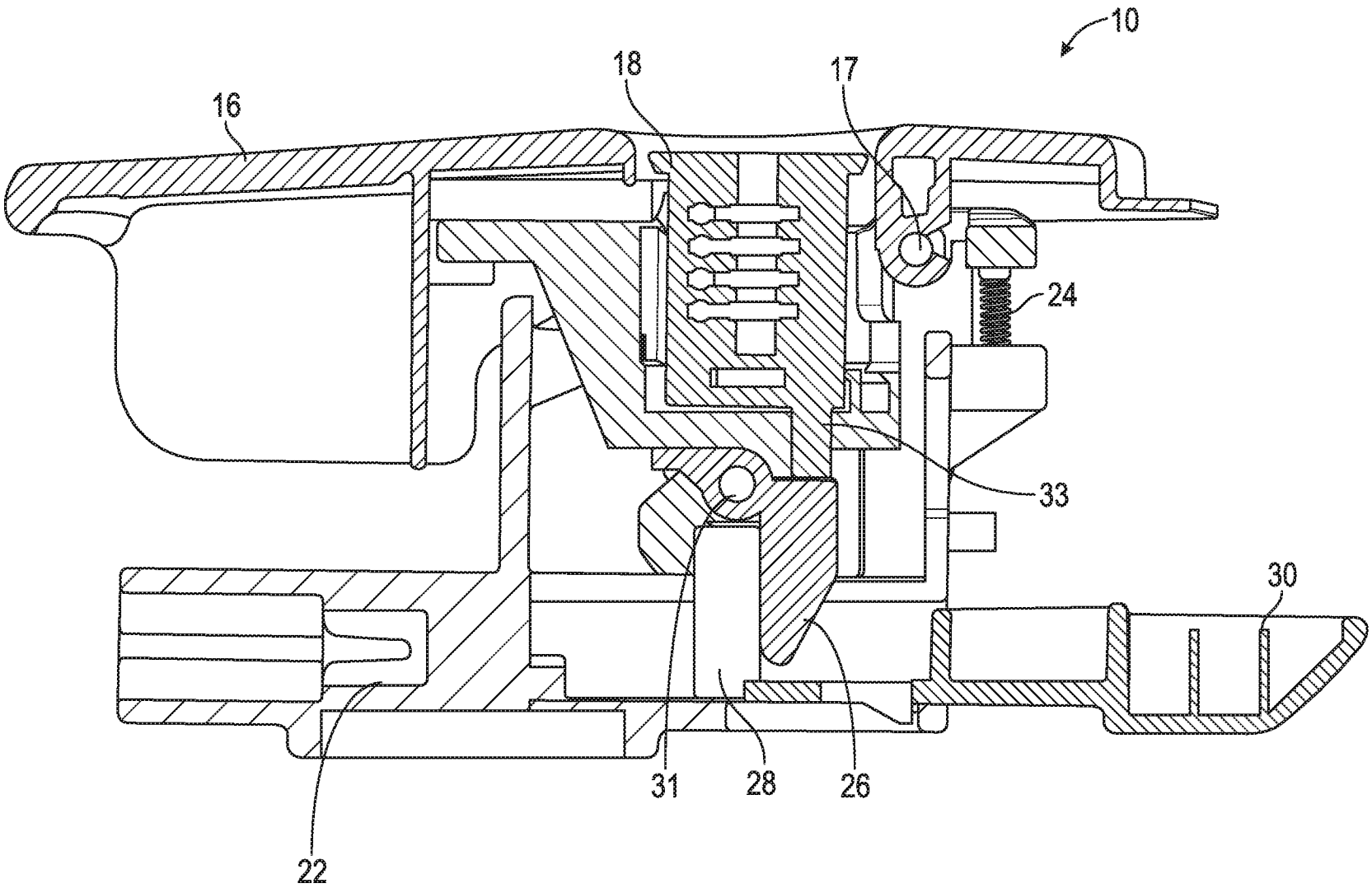
FIG. 4 is a close-up interior view of the door latch for the compartment in an unlocked position in accordance with the present disclosure.

Referring further to FIGS. 3 and 4, there is shown the door latch 10 in a locked state (FIG. 3) and in an unlocked state (FIG. 4). The notable difference between the unlocked state and the locked state is a finger or extension 33 that has a first position (FIG. 4) in which the extension 33 does not engage with the actuator 26 in the locked position and has a second position in which the extension 33 engages with the actuator 26 in the unlocked position.

Figure 5:
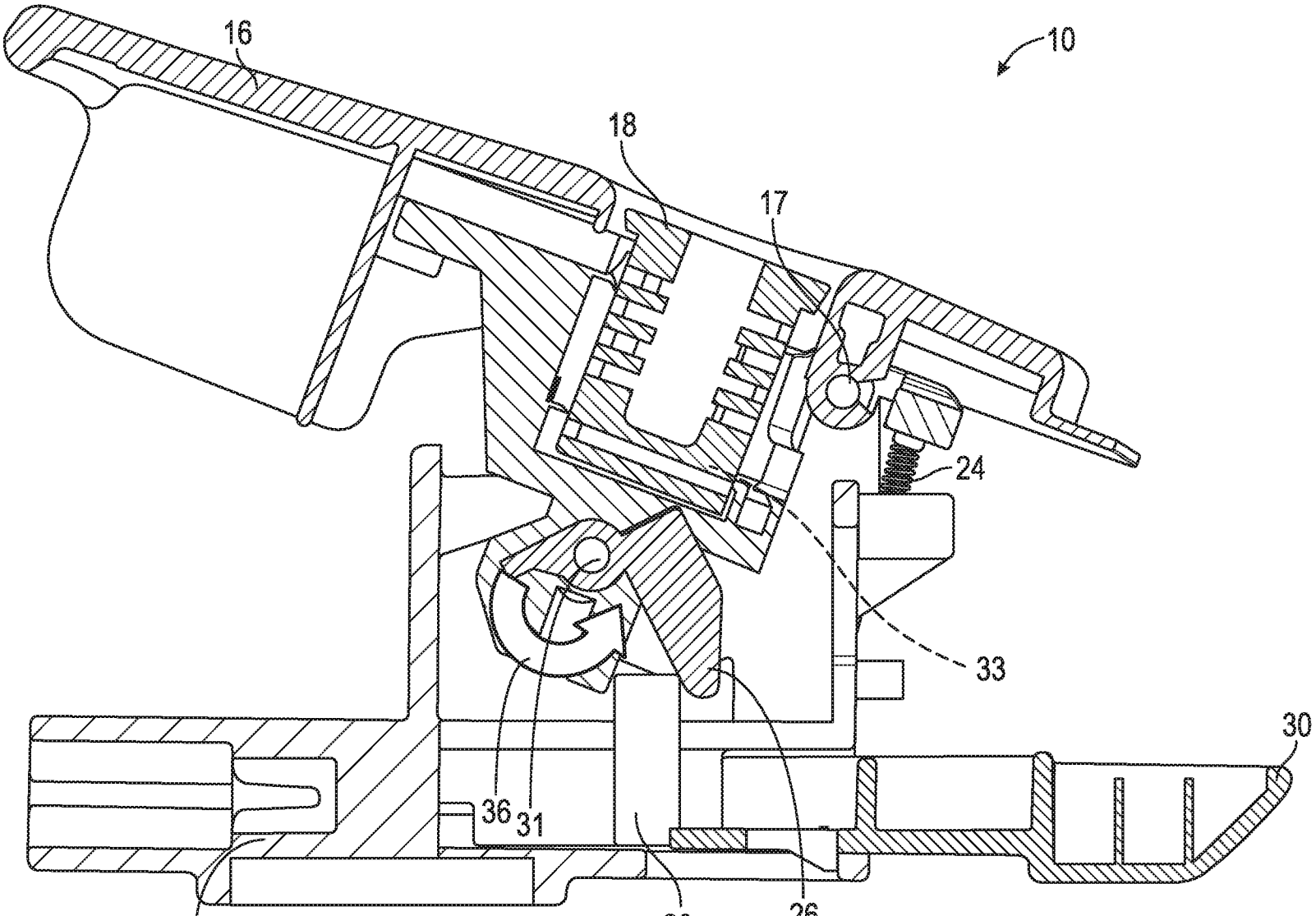
FIG. 5 is a close-up interior view of the door latch for the compartment in the locked position when a handle is lifted in accordance with the present disclosure.
Figure 6:
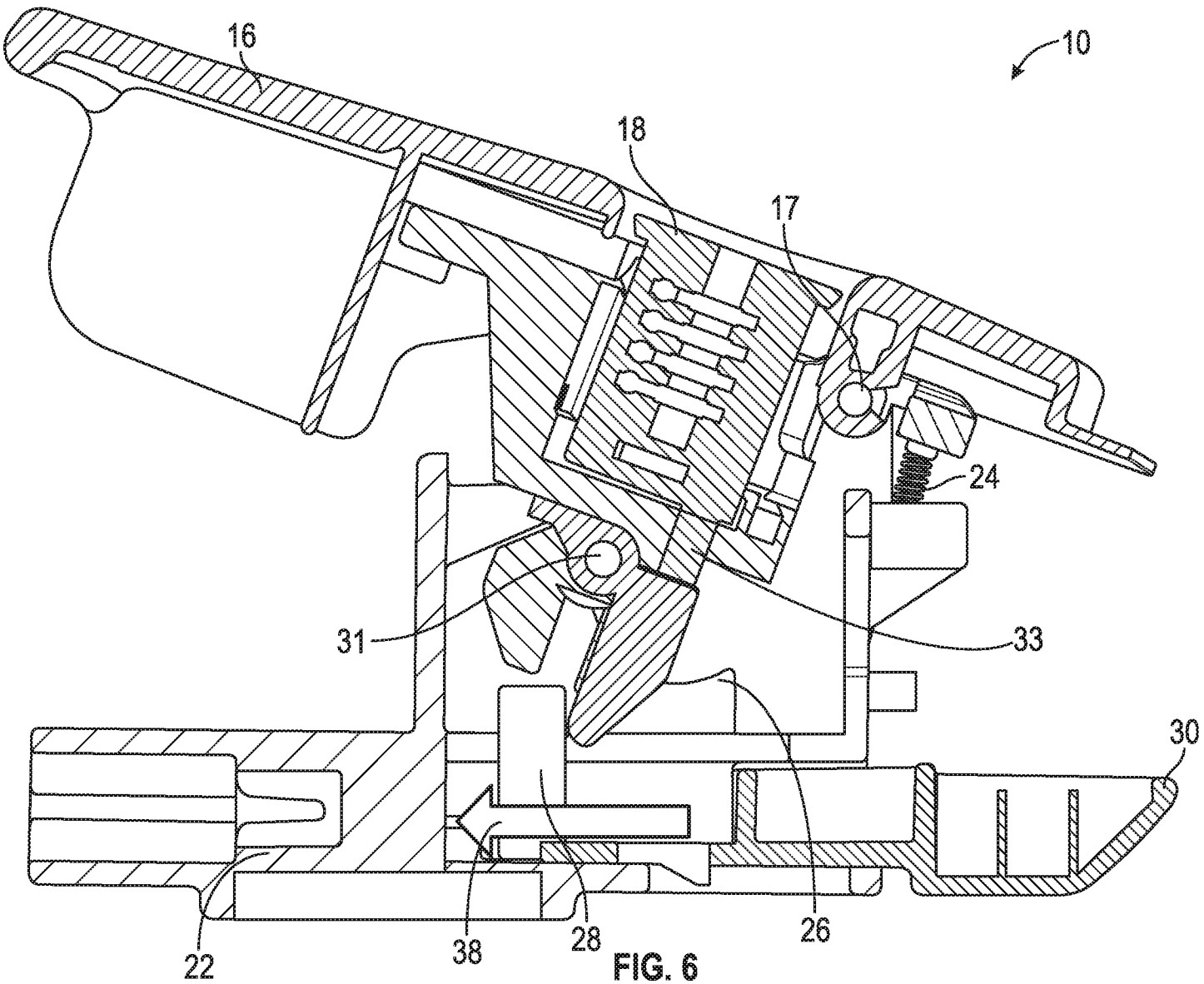
FIG. 6 is a close-up interior view of the door latch for the compartment in the unlocked position when a handle is lifted in accordance with the present disclosure.

Referring now to FIGS. 5 and 6, there is shown the handle 16 in a lifted position when the lock barrel 18 is locked (FIG. 5) and when the lock barrel 18 is unlocked (FIG. 6). When the lock barrel 18 is locked and as the handle 16 is lifted, the handle 16 and the lock barrel 18 rotate clockwise about the pivot point 17. Further, the extension 33 remains resided in the lock barrel 18 such that it does not engage with the actuator 26. The actuator 26 as shown in FIGS. 5 and 6 includes a biasing member, such as a spring, that biases or pushes the actuator 26 away from the portion 28 of the latch pawl 30. Hence, with the extension 33 in the first position (locked), as the lock barrel 18 pivots clockwise about the pivot point 17, the actuator 26 pivots counterclockwise about the pivot point 31. Accordingly, as the occupant lifts the handle 16, the actuator 26 pivots away from the portion 28 of the latch pawl 30, as indicated by the arrow 36, so that the end 32 of the latch pawl 30 remains engaged with the frame 14 (FIG. 2) to ensure that access to the compartment defined by the frame 14 is denied.

When the lock barrel 18 is unlocked, the extension 33 extends to its second position and engages with the actuator 26 as shown in FIGS. 4 and 6. As such, as the occupant lifts the handle 16, both the handle 16 and the lock barrel 18 pivot counterclockwise about the pivot point 17. As this occurs, the extension 33 pushes against the actuator 26 which causes the actuator 26 to rotate clockwise about the pivot point 31. In turn, clockwise rotation of the actuator 26 such that the actuator 26 pushes against the portion 28 of the latch pawl 30, which urges the latch pawl 30 in the direction indicated by the arrow 38. The movement of the latch pawl 30 in the direction of the arrow 38 disengages the end 32 of the latch pawl 30 from the frame 14. With the latch pawl 30 disengaged from the frame 14, the occupant is allowed access to the compartment defined by the frame 14.

A door latch of the present disclosure offers one of more advantages. For example, the latch door 10 described above prevents an excessive load to be applied to the latch door 10. Specifically, as the occupant, such as a driver or a passenger of the motor vehicle, or a thief, lifts the handle 16, the handle 16 merely rotates away from the door 12 without applying undo stress to the latch door 10 while the door 12 remains in the locked position to deny access to the compartment.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A door latch for a motor vehicle compartment, the door latch comprising:

a latch pawl having a locked position and an unlocked position, the locked position preventing access to the compartment, the unlocked position providing access to the compartment; a lock with a barrel and an extension that selectively extends from the barrel, the extension having a first position corresponding to the latch pawl's locked position and a second position corresponding to the latch pawl's unlocked position; and an actuator that rotates about a first pivot point, wherein when the barrel moves about a second pivot point and the extension is in the first position, the extension does not contact the actuator and the actuator rotates about the first pivot point and does not move the latch pawl such that the latch pawl remains in the locked position, and wherein when the barrel moves about the second pivot point and the extension is in the second position, the extension directly contacts the actuator and prevents the actuator from rotating which causes the actuator to engage with the latch pawl to move the latch pawl to the unlocked position.

2. The door latch of claim 1, wherein the barrel is housed in a handle and the handle is configured to rotate about the second pivot point.

3. The door latch of claim 2, wherein when an occupant of the motor vehicle pulls on the handle and the extension is in the first position, the handle rotates about the second pivot point while the latch pawl remains in the locked position.

4. The door latch of claim 2, wherein when an occupant of the motor vehicle pulls on the handle and the extension is in the second position, the handle rotates about the second pivot point and actuator rotates about the first pivot point to move the latch pawl to the unlocked position.

5. The door latch of claim 1, wherein the motor vehicle compartment is a glove box.

6. The door latch of claim 1, wherein the motor vehicle compartment is a console situated in a cabin of the motor vehicle.

7. A door latch for a motor vehicle compartment, the door latch comprising:

a handle;

a latch pawl having a locked position and an unlocked position, the locked position preventing access to the compartment, the unlocked position providing access to the compartment;

an actuator that rotates about a first pivot point, wherein the actuator is mounted to the handle, the actuator selectively engaging with the latch pawl to move the latch pawl from the locked position to the unlocked position; and a lock with a barrel and an extension that selectively extends from the barrel, the extension having a first position corresponding to the latch pawl's locked position and a second position corresponding to the latch pawl's unlocked position, wherein when the barrel moves about a second pivot point and the extension is in the first position, the extension does not contact the actuator and the actuator rotates about the first pivot point and does not move the latch pawl such that the latch pawl remains in the locked position, and wherein when the barrel moves about the second pivot point and the extension is in the second position, the extension directly contacts the actuator and prevents the actuator from rotating which causes the actuator to engage with the latch pawl to move the latch pawl to the unlocked position.

8. The door latch of claim 7, wherein when an occupant of the motor vehicle pulls on the handle and the extension is in the first position, the handle rotates about the second pivot point while the latch pawl remains in the locked position.

9. The door latch of claim 8, wherein when an occupant of the motor vehicle pulls on the handle and the extension is in the second position, the handle rotates about the second pivot point and actuator rotates about the first pivot point to move the latch pawl to the unlocked position.

10. The door latch of claim 7, wherein the motor vehicle compartment is a glove box.

11. The door latch of claim 7, wherein the motor vehicle compartment is a console situated in a cabin of the motor vehicle.

12. A motor vehicle comprising:

a compartment with a door latch, the door latch including:

a handle;

a latch pawl having a locked position and an unlocked position, the locked position preventing access to the compartment, the unlocked position providing access to the compartment;

an actuator that rotates about a first pivot point, wherein the actuator is mounted to the handle, the actuator selectively engaging with the latch pawl to move the latch pawl from the locked position to the unlocked position; and a lock with a barrel and an extension that selectively extends from the barrel, the extension having a first position corresponding to the latch pawl's locked position and a second position corresponding to the latch pawl's unlocked position, wherein when the barrel moves about a second pivot point and the extension is in the first position, the extension does not contact the actuator and the actuator rotates about the first pivot point and the actuator does not engage with the latch pawl such that the latch pawl remains in the locked position, and wherein when the barrel moves about the second pivot point and the extension is in the second position, the extension directly contacts the actuator and prevents the actuator from rotating which causes the actuator to engage with the latch pawl to move the latch pawl to the unlocked position.

* * * * *